US005969584A

United States Patent [19]

Huang et al.

[11] Patent Number: 5,969,584

[45] Date of Patent: Oct. 19, 1999

[54] RESONATING STRUCTURE PROVIDING NOTCH AND BANDPASS FILTERING

[75] Inventors: Guanghua Huang; Lasse Beli Ravaska; Kimmo Antero Kyllonen, all of Hutchinson, Minn.

[73] Assignee: ADC Solitra Inc., Hutchinson, Minn.

[21] Appl. No.: 08/886,990

[22] Filed: Jul. 2, 1997

[51] Int. Cl.[6] ..... H01P 1/20; H01P 7/10

[52] U.S. Cl. ..... 333/202; 333/206; 333/219.1; 333/235

[58] Field of Search ..... 333/202, 206, 333/207, 208, 209, 212, 219.1, 230, 235

[56] References Cited

U.S. PATENT DOCUMENTS

| | | | |
|---|---|---|---|
| 4,453,146 | 6/1984 | Fiedziuszko | 333/212 |
| 5,684,438 | 11/1997 | Cavalieri D'Oro et al. | 333/202 |
| 5,739,733 | 4/1998 | Cameron | 333/202 |

FOREIGN PATENT DOCUMENTS

| | | | |
|---|---|---|---|
| 0 759 645 | 2/1997 | European Pat. Off. . | |
| 0 760 534 | 3/1998 | European Pat. Off. . | |
| 54 018 260 | 2/1979 | Japan . | |
| 4-304004 | 10/1992 | Japan | 333/202 |
| 6-13801 | 1/1994 | Japan | 333/202 |
| 532 864 | 2/1973 | Switzerland . | |
| 1 338 742 | 11/1973 | United Kingdom . | |

*Primary Examiner*—Seungsook Ham

*Attorney, Agent, or Firm*—Merchant, Gould, Smith, Edell, Welter & Schmidt

[57] ABSTRACT

A combination notch/bandpass filter uses first and second adjacently-located cavities in the conductive housing to respectively provide a tunable, first-stage notch filter and a second-stage bandpass filter. An opening in a wall provides a passage for energy from the first cavity to the second cavity. In the first cavity, a resonator is located adjacent the opening, along with a notch-filter tuning member having one end arranged opposite the resonator and spaced therefrom by a distance to permit the wide end of a coupler to be suspended therebetween. An elongated portion of the coupler carries filtered energy from the first cavity to the second cavity.

15 Claims, 5 Drawing Sheets

RESONATING STRUCTURE PROVIDING NOTCH AND BANDPASS FILTERING

FIELD OF THE INVENTION

The present invention relates generally to structures and techniques for filtering radio waves, and, more particularly, the implementation of such filters using resonator cavities.

BACKGROUND OF THE INVENTION

Radio frequency (RF) equipment uses a variety of approaches and structures for receiving and transmitting radio waves in selected frequency bands. Typically, filtering structures are used to maintain proper communication in frequency bands assigned to a particular band. The type of filtering structure used often depends upon the intended use and the specifications for the radio equipment. For example, dielectric and coaxial cavity resonator filters are often used for filtering electromagnetic energy in certain frequency bands, such as those used for cellular and PCS communications. Typically, such filter structures are implemented using a number of coupled dielectric or coaxial resonator structures. Coaxial dielectric resonators in such filters are coupled via capacitors, strip transmission lines, transformers, or by apertures in walls separating the resonator structures. The number of resonator structures used for any particular application also depends upon the system specifications. Increasing the number of intercoupled resonator structures improves performance in some application environments.

A conventional bandpass filter, for example, consists of several coaxial-type cavity resonators forming a multi-pole filter. A relatively large number of poles are used for adequate attenuation in the stop band at a given frequency distance from the pass band. As the number of poles increases, however, the insertion loss in the pass band also increases due to the loss of the resonators and cavities. While it is desirable to minimize the insertion loss, a lower insertion loss limits the number of poles. The stop band attenuation is also limited as a result. Thus, achieving low insertion loss in the pass band with higher attentuation in the stop band close to the pass band becomes a very challenging issue in some applications, for instance, cellular-phone communication.

SUMMARY OF THE INVENTION

According to one embodiment, the present invention is directed to a resonator filter having an enclosed conductive housing. The filter comprises: first and second resonator cavities in the conductive housing; a wall separating the first resonator cavity from the second resonator cavity, and having an energy-coupling opening extending through the wall and linking the first and second resonator cavities; a resonator within the first resonator cavity and having a surface facing one side of the housing; a conductive member having a surface arranged opposite the surface of the resonator and spaced therefrom by a certain distance; and a coupler having a relatively wide and flat portion arranged between the resonator and the conductive member and having a relatively elongated section constructed and arranged to extend into and to couple energy through the opening from the first resonator cavity to the second resonator cavity.

Another embodiment of the present invention is directed to a combination notch/bandpass filter having an enclosed conductive housing. The filter comprises: first and second adjacently-located cavities in the conductive housing; a wall separating the first cavity from the second cavity, and having an energy-coupling aperture extending through the wall and providing a passage for energy from the first cavity to the second cavity; a resonator within the first cavity, the resonator having a surface facing one side of the housing and located adjacent the aperture, the resonator supported by a post extending from an opposite side of the housing; a coaxial resonator center located within the second resonator cavity and arranged to provide a bandpass filter; a notch-filter tuning member having one end arranged opposite the surface of the resonator and spaced therefrom by a tunably adjustable distance; and a coupler having a relatively wide end suspended between the resonator and the conductive member and having opposing surfaces respectively facing the resonator and the conductive member and having a relatively elongated portion constructed and arranged to extend through the opening from the first resonator cavity to the second resonator cavity.

Yet another aspect of the present invention is directed to a method for notch-filtering and bandpass-filtering energy using a resonator filter having an enclosed conductive housing. The method comprises: providing first and second cavities in the conductive housing with a wall separating the first cavity from the second cavity and with an opening in the wall for conducting energy between the first and second cavities; arranging a resonator member within the first cavity with a surface of the resonator member facing a side of the housing; spacing a conductive member opposite the surface of the resonator by a certain distance; providing an intracavity energy coupler having a relatively wide end and a relatively elongated portion; suspending the relatively wide end of the coupler between the resonator and the conductive member and arranging the relatively elongated portion to present filtered energy from the first cavity to the second cavity; and arranging a metal post in the second cavity to provide a coaxial resonator bandpass filter for energy passing therethrough in a direction from the first cavity.

The above summary of the present invention is not intended to describe each disclosed embodiment of the present invention. This is the purpose of the figures and of the detailed description that follows.

BRIEF DESCRIPTION OF THE DRAWINGS

Other aspects and advantages of the invention will become apparent upon reading the following detailed description and upon reference to the drawings in which.

Figure 1:
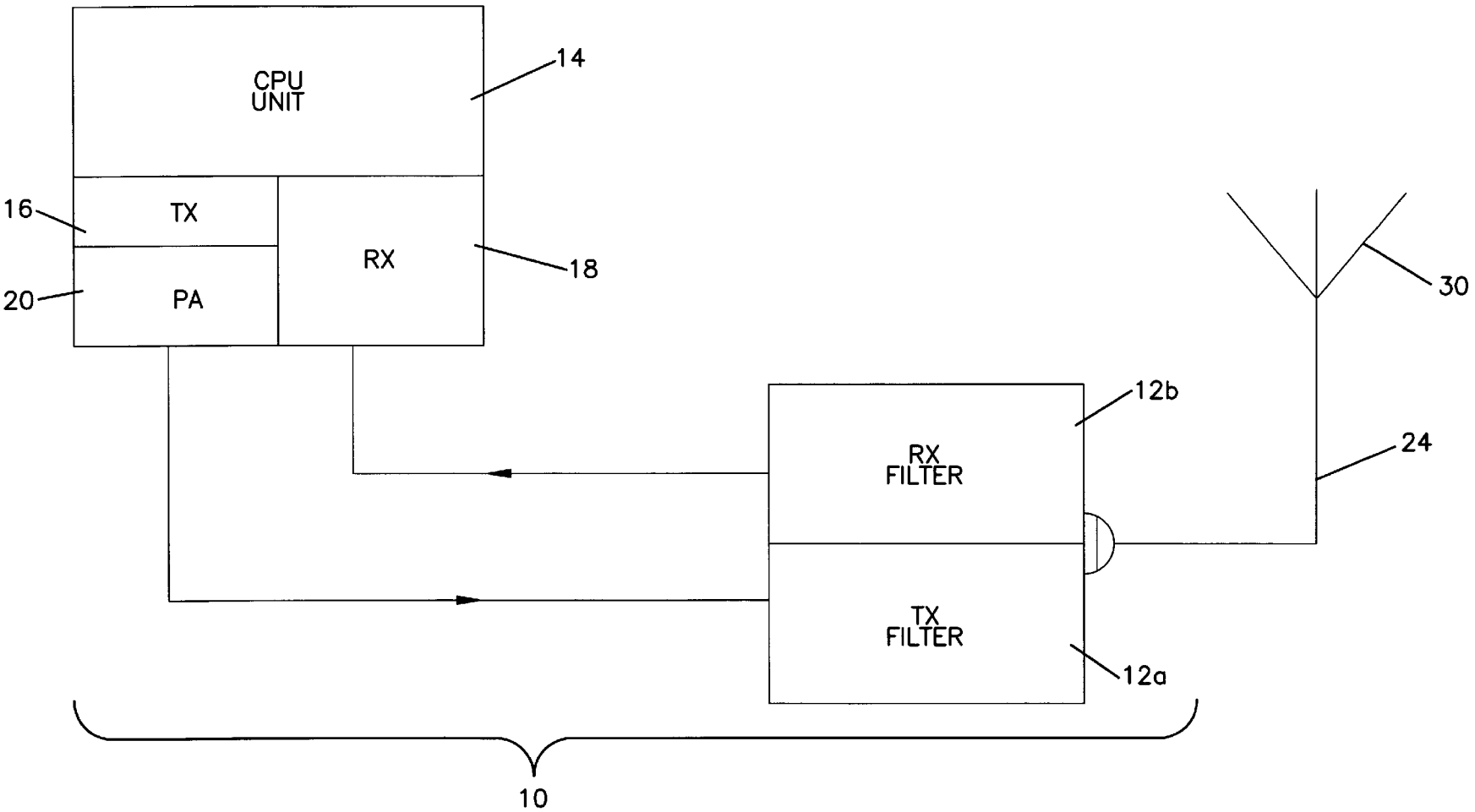
FIG. 1 is an illustration of a cellular communications radio incorporating a filter structure, according to a particular embodiment of the present invention.

While the invention is susceptible to various modifications and alternative forms, specific embodiments thereof have been shown by way of example in the drawings and will herein be described in detail. It should be understood, however, that the detailed description is not intended to limit the invention to the particular forms disclosed. On the contrary, the intention is to cover all modifications, equivalents, and alternatives falling within the spirit and scope of the invention as defined by the appended claims.

DETAILED DESCRIPTION

The present invention is believed to be applicable to a variety of radio frequency (RF) applications in which achieving low insertion loss in the pass band with high attentuation in the stop band close to the pass band is desirable. The present invention has been found to be particularly applicable and beneficial in cellular-communication applications in which insufficient attenuation in the stop band leads to interference between the adjacent transmit and receive bands for a given duplex channel. While the present invention is not so limited, an appreciation of the present invention is best presented by way of a particular example application, in this instance, in the context of cellular communication.

Turning now to the drawings, FIG. 1 illustrates a cellular radio 10 or base station incorporating a pair of filter structures 12*a* and 12*b* according to a particular embodiment of the present invention. The radio 10 is depicted generally, so as to represent a wide variety of arrangements and constructions. The illustrated radio 10 includes a CPU-based central control unit 14, audio and data signal processing circuitry 16 and 18 for the respective transmit and receive signalling, a power amplifier 20 for the transmit signalling, and a coaxial cable 24. The coaxial cable 24 carries both the transmit and receive signals between the radio 10 and an antenna 30. The purpose of the filters 12*a* and 12*b* is to ensure that signals in a receive (RX) frequency band do not overlap with signals in a neighboring transmit (TX) frequency band.

Figure 2:
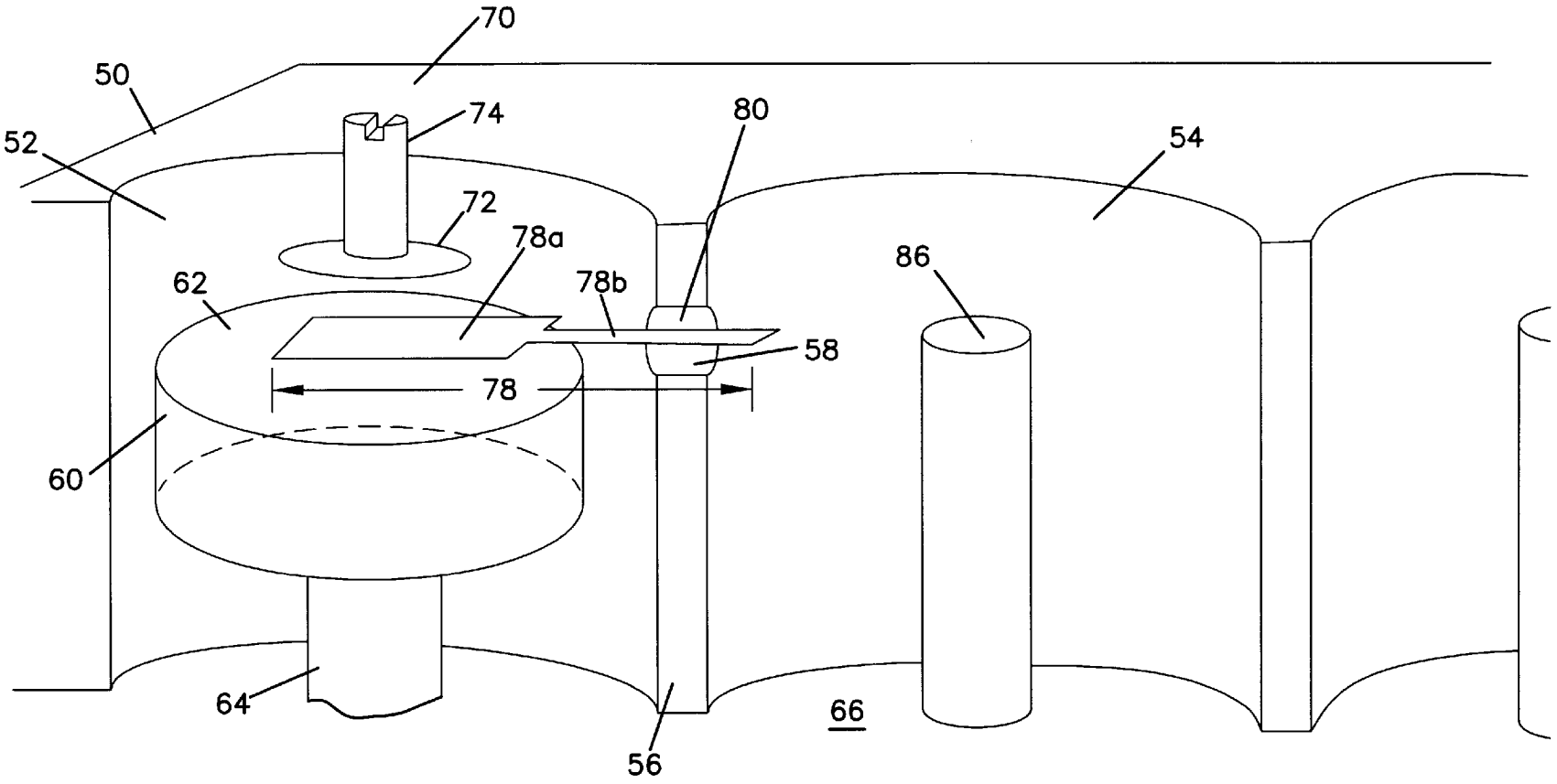
FIG. 2 is a cut-away view of the filter structure of FIG. 1, according to one embodiment of the present invention.

In FIG. 2, an example filter structure for implementing each of the filters 12*a* and 12*b* is shown in a perspective, cut-away view with a full-enclosure housing cover (not shown) removed. The filter structure is implemented using a combination notch/bandpass filter enclosed in a conductive housing 50. The filter structure includes several resonator cavities, including illustrated adjacently-located cavities 52 and 54 implementing a dielectric resonator and a coaxial resonator, respectively.

The cavity 52 providing the notch filter need not be located in the first location as shown, but can be arranged at any subsequent location along the energy path. The cavities 52 and 54 are separated by a conductive wall 56, which may be implemented using either a separate insert or manufactured as part of the housing 50. In this specific implementation of FIG. 2, the wall 56 forms part of each cavity 52 and 54 and has an energy-coupling aperture 58 that provides a passage for energy from the cavity 52 to the cavity 54.

The dielectric resonator within the cavity 52 is constructed and arranged to provide a notch filter with a relatively high Q. The resonator includes a resonator volume 60 having an upper surface 62 facing the upper wall, or cover, of the housing and located just below the aperture 58. The resonator volume 60 is supported by a post 64 extending from and supported by a bottom floor 66 of the housing 50. The volume 60 may be implemented using one of several commercially available parts, e.g., as sold by Trans-Tech of Adamstown City, Md. The post 64 may be implemented using any of a variety of supportive materials, e.g., aluminum or Teflon® (a polymer material).

A tuning member 70 having one surface end 72 arranged opposite the surface 62 of the resonator volume 60 is spaced from the surface 62 by a distance that is set externally using, for example, a threaded rotatable shaft 74 controlled in the same manner as a conventional tuning screw. The tuning member 70 is adjusted to provide a notch at a certain frequency, as the energy is passed through the cavity 52. This construction in the cavity 52 absorbs energy in the narrow "notch" band.

The energy is passed through the cavity 52 to the cavity 54 for bandpass filtering using a coupler 78. The coupler 78 has a relatively wide, flat end 78*a* suspended between the resonator volume 60 and the tuning member 70 and has a relatively elongated portion 78*b* extending into, and preferably through, the opening to carry energy from the cavity 52 to the cavity 54. In the illustrated embodiment of FIG. 2, the coupler 78 is supported by a nonconducting (e.g., Teflon®) (a non-conducting polymer) collar 80 that frictionally engages the elongated portion 78*b*, and the collar 80 itself is secured by friction within the walls providing the aperture. The coupler 78 may also be supported using means other than the collar 80, for example, using a nonconductive member or assembly having a pair of paperclip-like slip members, one gripping the wall 56 and one gripping the elongated portion 78*b* of the coupler 78. Both the coupler 78 and the tuning member 70 may be implemented using a (low-loss) conductor, such as copper or aluminum plated with silver.

As the energy is passed along the coupler 78 through the aperture into the cavity 54, bandpass filtering is provided using a conventional coaxial resonator structure. A coaxial resonator center 86 has a length that is selected to set the resonant frequency for the bandpass filter. Filtered energy from the cavity 54 is passed to another resonator cavity or set of resonator cavities or to an output port via a conventional aperture-coupler (not shown).

Figure 3:
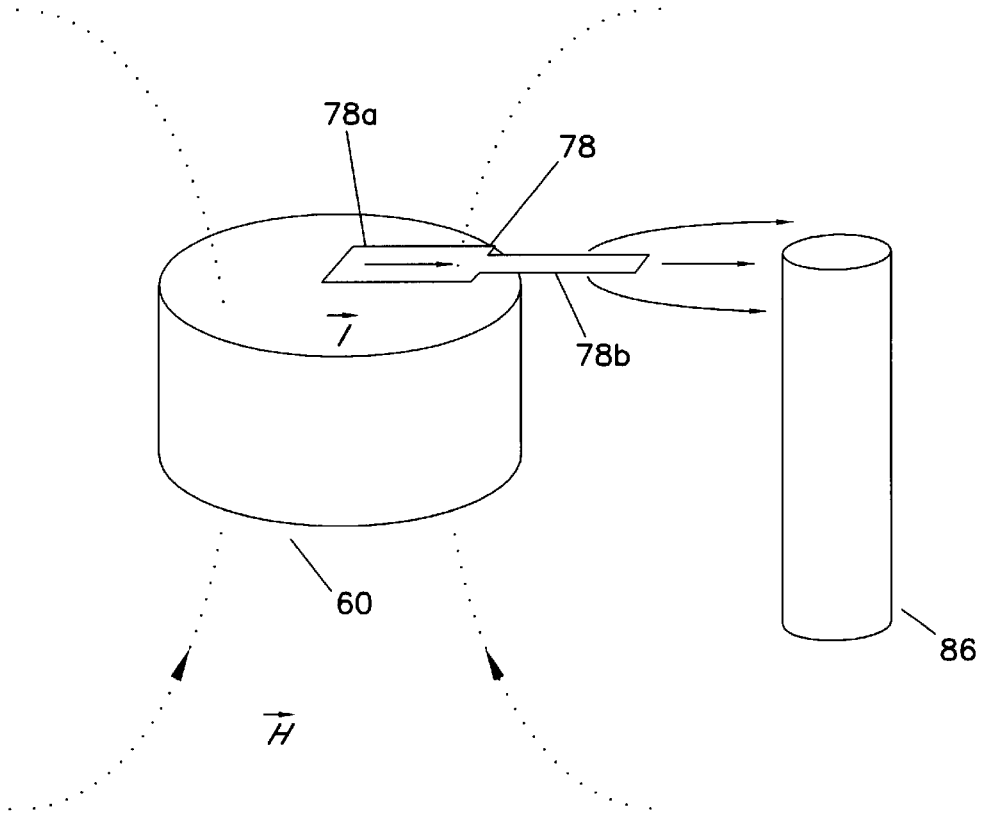
FIG. 3 is a perspective view of portions of the filter structure shown in FIG. 2.

FIG. 3 illustrates the transfer of energy via the coupler 78, the resonator volume 60 and coaxial resonator center 86, corresponding to the arrangement and structure shown in FIG. 2. In FIG. 3, the magnetic field intensity vector H depicts the magnetomotive force within the cavity (52 of FIG. 1) being picked up by the wide end 78*a* of the coupler 78 and carried as an electric current I along the elongated portion 78*b* to the adjacent cavity (54 of FIG. 2). The magnetic field generates current in the coupler 78 according to the following equation:

$$I=n\times H.$$

The wide end 78*a* of the coupler 78 has electric and magnetic fields coupling between the coupler 78 and the resonator volume 60. Accordingly, the structure of the coaxial resonator in the second illustrated cavity 54 can be implemented using a straight center, as shown in FIG. 2, or a looped center.

Figure 4:
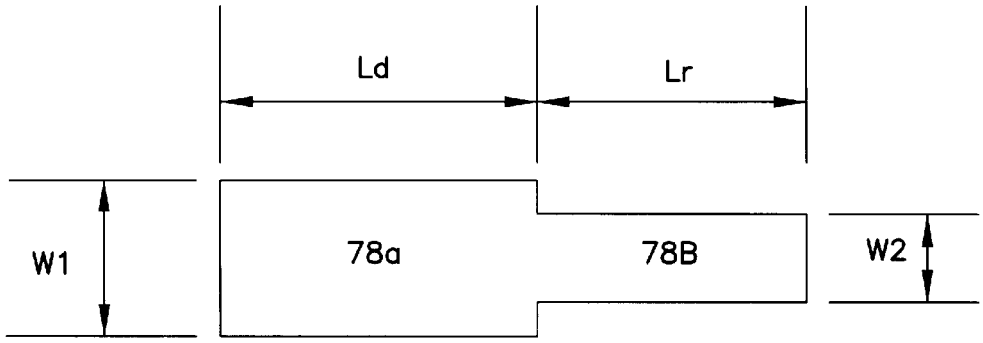
FIG. 4 is a top view of a coupler structure shown in FIGS. 2 and 3.

FIG. 4 illustrates, from a top view, the dimensions of the wide end 78*a* and the elongated portion 78*b* of the specific coupler 78 illustrated in the embodiment of FIGS. 2 and 3. The width of the wide end 78*a* (W1) is 18 mm, and its length (Ld) is 5 mm. With respect to the elongated portion 78*b*, its width (W2) is 2.6 mm, and its length (Ld) is 15 mm. The distance from the coupler 78 to the top of the volume surface 62 is 22 mm. It should be understood that these distance figures are estimates.

Alternatively, the width of the coupler 78 may be tapered from the wide end 78*a* to the elongated portion 78*b* for use in certain applications.

Figure 5:
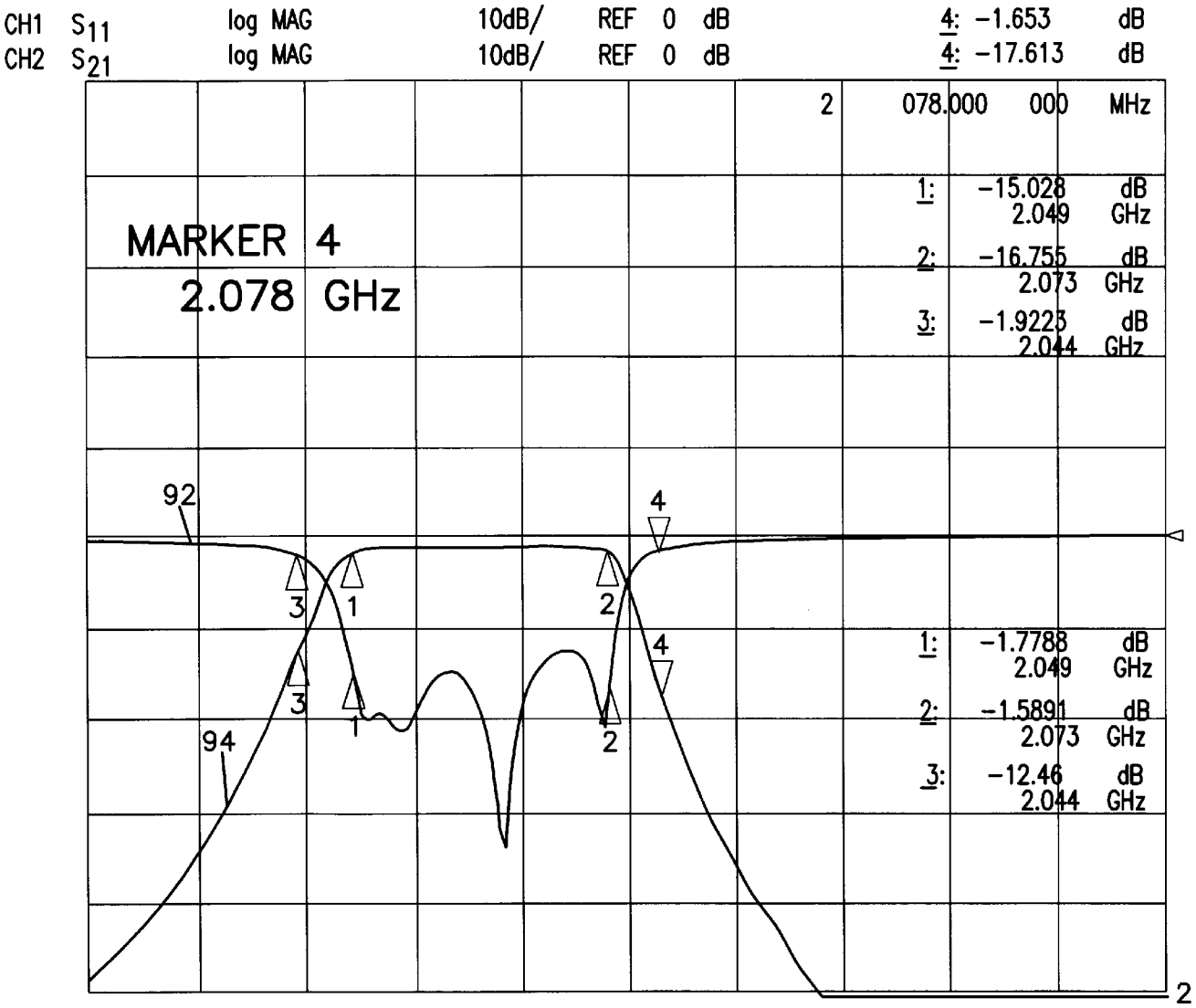
FIGS. 5 and 6 are graphs illustrating the performance, for a particular application and embodiment, of the filter structure of FIG. 2.
Figure 6:
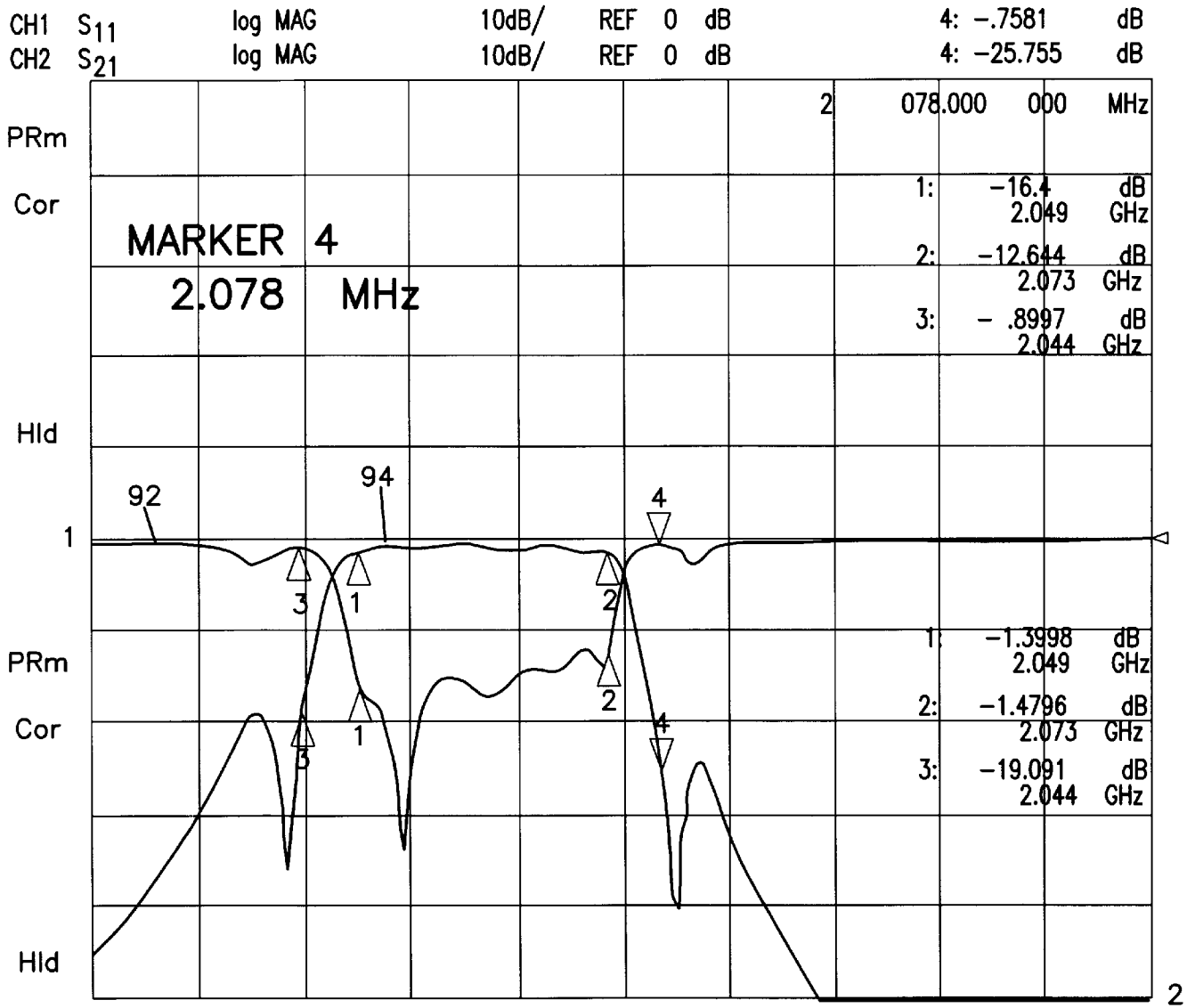

FIGS. 5 and 6 are graphs of the reflection coefficient and the insertion loss 92 and 94, respectively, illustrating the performance of the coaxial filter structure of FIG. 2 in an application cascading five of the coaxial resonator structures (each depicted in FIG. 2) to provide a bandpass filter. The performance, with and without the benefit of two cascaded notch resonator structures (each as depicted in FIG. 2), is shown at a frequency band centered around a center frequency of 2.075 GHz. FIG. 5 shows the frequency response of the coaxial resonator (providing the bandpass filter) without the dielectric resonator filter structures operating to provide the notch filter. In FIG. 5, the attenuation at the frequency of 5 MHz (marker 3) from the edge of the pass band (marker 1) is only −10 dB. This degree of attenuation is insufficient for certain application environments in which an attenuation of −20 dB and an associated insertion loss of less than 1.0 dB are desired. FIG. 6 shows the frequency response for the same filter with two of the dielectric resonator filter structures operating to provide notch filters. The two notches are set at frequencies of 5 MHz from the lower and higher edges of the pass band, as illustrated in FIG. 6. The attenuation in the notch frequencies is improved substantially, to below −20 dB without increasing the insertion loss in the pass band.

Accordingly, the present invention provides, among other aspects, a filtering structure and method providing both bandpass and notch filter functions in the same set of resonator cavities. Other aspects and embodiments of the present invention will be apparent to those skilled in the art from consideration of the specification and practice of the invention disclosed herein. It is intended that the specification and illustrated embodiments be considered as exemplary only, with a true scope and spirit of the invention being indicated by the following claims.

What is claimed is:

1. A resonator filter having an enclosed conductive housing, the filter comprising:

first and second resonator cavities in the conductive housing;

a wall separating the first resonator cavity from the second resonator cavity, and having an energy-coupling opening extending through the wall and linking the first and second resonator cavities;

a resonator within the first resonator cavity and having a surface facing one side of the housing;

a conductive member having a surface arranged opposite the surface of the resonator and spaced therefrom by a certain distance, wherein the resonator and the conductive member in the first resonator cavity are arranged to provide a notch filter;

a coupler having a relatively wide and flat portion arranged between the resonator and the conductive member and having a relatively elongated section constructed and arranged to extend into and to couple energy through the opening from the first resonator cavity to the second resonator cavity; and a coaxial resonator center located within the second resonator cavity and arranged to provide a bandpass filter.

2. A resonator filter, according to claim 1, wherein the energy-coupling opening is a hole surrounded by the wall and located along a plane even with the coupler.

3. A resonator filter, according to claim 1, wherein the coupler is suspended between the resonator and the conductive member by a support provided at the energy-coupling opening.

4. A resonator filter, according to claim 1, wherein a width of the coupler decreases discontinuously from the relatively wide and flat portion to the relatively elongated section.

5. A resonator filter, according to claim 1, wherein the conductive member in the first resonator cavity is adjustably arranged to tune the notch filter.

6. A combination notch/bandpass filter having an enclosed conductive housing, the combination notch/bandpass filter comprising:

first and second adjacently-located cavities in the conductive housing;

a wall separating the first cavity from the second cavity, and having an energy-coupling aperture extending through the wall and providing a passage for energy from the first cavity to the second cavity;

a resonator within the first cavity, the resonator having a surface facing one side of the housing and located adjacent the aperture, the resonator supported by a post extending from an opposite side of the housing;

a coaxial resonator center located within the second resonator cavity and arranged to provide a bandpass filter;

a notch-filter tuning member having one end arranged opposite the surface of the resonator and spaced therefrom by a tunably adjustable distance; and a coupler having a relatively wide end suspended between the resonator and the conductive member and having opposing surfaces respectively facing the resonator and the conductive member and having a relatively elongated portion constructed and arranged to extend through the aperture from the first resonator cavity to the second resonator cavity.

7. A combination notch/bandpass filter, according to claim 6, wherein the coupler is suspended between the resonator and the conductive member by a support member located in the aperture.

8. A radio comprising:

a combination notch/bandpass filter having first and second adjacently-located cavities in the conductive housing, a wall separating the first cavity from the second cavity, and having an energy-coupling aperture extending through the wall and providing a passage for energy from the first cavity to the second cavity, a resonator within the first cavity, the resonator having a surface facing one side of the housing and located adjacent the aperture, the resonator supported by a post extending from an opposite side of the housing, a coaxial resonator center located within the second resonator cavity and arranged to provide a bandpass filter, a notch-filter tuning member having one end arranged opposite the surface of the resonator and spaced therefrom by a tunably adjustable distance, and a coupler having a relatively wide end suspended between the resonator and the conductive member and having opposing surfaces respectively facing the resonator and the conductive member and having a relatively elongated portion constructed and arranged to extend through the aperture from the first resonator cavity to the second resonator cavity; and a power amplifier coupled to the combination notch/bandpass filter.

9. A combination notch/bandpass filter, according to claim 6, wherein the coupler is suspended between the resonator and the conductive member by a support member retained by a wall at least partly defining the aperture.

10. A combination notch/bandpass filter, according to claim 6, wherein the coupler is suspended between the resonator and the conductive member by a non-conducting support member located in the aperture.

11. A resonator filter having an enclosed conductive housing, the filter comprising:

first and second cavities in the conductive housing;

a wall separating the first cavity from the second cavity, and having coupling means for conducting energy between the first and second cavities;

a resonator within the first cavity and having a surface facing one side of the housing;

a conductive member having a surface arranged opposite the surface of the resonator and spaced therefrom by a certain distance, wherein the resonator and the conductive member in the first cavity are arranged to provide a notch filter;

elongated energy-coupling means arranged between the resonator and the conductive member without contacting the resonator or the conductive member, the elongated energy-coupling means constructed and arranged in conjunction with the coupling means to present filtered energy from the first cavity to the second cavity; and means in the second cavity arranged, in conjunction with the second cavity, to provide a bandpass filter for energy passing therethrough in a direction from the first cavity.

12. A resonator filter having an enclosed conductive housing, according to claim 11, wherein the certain distance between the surface of the conductive member and the surface of the resonator is adjustable for tuning the filter.

13. A resonator filter having an enclosed conductive housing, according to claim 11, wherein the conductive member includes a tuning shaft.

14. A method for notch-filtering and bandpass-filtering of energy using a resonator filter having an enclosed conductive housing, the method comprising:

providing first and second cavities in the conductive housing with a wall separating the first cavity from the second cavity and with an opening in the wall for conducting energy between the first and second cavities;

arranging a resonator member within the first cavity with a surface of the resonator member facing a side of the housing;

spacing a conductive member opposite the surface of the resonator by a certain distance, wherein the resonator member and the conductive member in the first cavity are arranged to form a notch filter;

providing an intracavity energy coupler having a relatively wide end and a relatively elongated portion;

suspending the relatively wide end of the coupler between the resonator and the conductive member and arranging the relatively elongated portion to present filtered energy from the first cavity to the second cavity; and arranging a metal post in the second cavity to provide a coaxial resonator bandpass filter for energy passing therethrough in a direction from the first cavity.

15. A method for notch-filtering and bandpass-filtering of energy, according to claim 14, further including tuning the notch filter in the first cavity using the conductive member.

* * * * *